US006991443B2

(12) United States Patent
Aoki et al.

(10) Patent No.: US 6,991,443 B2
(45) Date of Patent: Jan. 31, 2006

(54) OIL INJECTED SCREW COMPRESSOR

(75) Inventors: Masakazu Aoki, Shizuoka (JP); Masahiko Takano, Shizuoka (JP); Masaaki Toda, Fuji (JP)

(73) Assignee: Hitachi Industrial Equipment Systems Co., Ltd., Chiba (JP)

( * ) Notice: Subject to any disclaimer, the term of this patent is extended or adjusted under 35 U.S.C. 154(b) by 0 days.

(21) Appl. No.: 10/775,193

(22) Filed: Feb. 11, 2004

(65) Prior Publication Data

US 2004/0184941 A1 Sep. 23, 2004

(51) Int. Cl.
*F01C 1/16* (2006.01)
*F03C 2/00* (2006.01)

(52) U.S. Cl. ..... 418/201.1; 418/97; 418/DIG. 1; 55/400; 55/406; 55/DIG. 17

(58) Field of Classification Search ..... 418/201.1, 418/97, DIG. 1; 55/400, 406, DIG. 17
See application file for complete search history.

(56) References Cited

U.S. PATENT DOCUMENTS 2,642,949 A * 6/1953 Tyskewicz ..... 96/211
3,191,854 A * 6/1965 Lowler et al. ..... 418/97
3,386,230 A * 6/1968 Riesberg et al. ..... 55/337
4,070,166 A * 1/1978 Emanuelsson ..... 418/97

FOREIGN PATENT DOCUMENTS

JP 60-216092 10/1985
JP 63-106394 5/1988

* cited by examiner

*Primary Examiner*—Theresa Trieu
(74) *Attorney, Agent, or Firm*—Antonelli, Terry, Stout and Kraus, LLP.

(57) ABSTRACT

An oil injected screw compressor has an oil separating mechanism integrated with a compressor and hence is made compact in size. A male rotor and a female rotor are received in a rotor casing. The shafts of these rotors are arranged substantially in a horizontal direction. An inner cylindrical wall is arranged under the rotor casing with its center axis arranged substantially in a vertical direction and an outer wall is arranged substantially in a concentric position with the inner wall. A lower casing is hermetically joined to the outer wall. Oil in the working gas which is injected in the compression process of the oil injected screw compressor is primarily separated from the working gas between the inner wall and the outer wall. The primarily separated working gas flows up inside the inner wall and is guided through a manifold into an oil separating element case where the oil is secondarily separated from the working gas.

24 Claims, 3 Drawing Sheets

OIL INJECTED SCREW COMPRESSOR

BACKGROUND OF THE INVENTION

The invention relates to an oil injected screw compressor that oil is injected into its compression chamber at the time of cooling compression heat generated in the main body of the compressor.

In an oil injected screw compressor in the related art, for example, as described in JP-A-63-106394, compressed air that is discharged from the main body of the compressor and contains oil is introduced into a container called an oil separator through piping. Moreover, another example of the oil injected screw compressor is disclosed in JP-A-60-216092. In the oil injected screw compressor disclosed in JP-A-60-216092, the main body of a compressor is built in an oil separator.

In the oil injected screw compressor disclosed in JP-A-63-106394, the oil separator is provided separately from the main body of a compressor, so piping for connecting the oil separator to the main body of the compressor is required, which makes it difficult to reduce the size of the compressor. On the other hand, in the oil injected screw compressor which is disclosed in JP-A-60-216092 and whose main body is built in the oil separator, in order to separate oil effectively by an oil separating element provided in the oil separator, the distance between the oil separating element and the surface of oil needs to be made large. As a result, the oil separator is made large in diameter to make it difficult to reduce the size of the oil injected screw compressor. In addition, the oil injected screw compressor disclosed in this publication needs to have oil in the oil separator drained when the main body of the compressor is overhauled, so that it is inadequate with respect to maintenance.

SUMMARY OF THE INVENTION

An object of the invention is to provide an oil injected screw compressor that can be made compact in size.

In order to achieve the above object, in accordance with one aspect of the invention, there is provided an oil injected screw compressor in which oil is injected into working gas to cool the working gas and which includes: a male rotor arranged substantially in a horizontal direction; a female rotor arranged in parallel to the male rotor; a main body casing an air end casing of the compressor having a rotor casing for containing these rotors; an inner cylindrical wall located under the rotor casing and having a center axis substantially in a vertical direction; an outer wall arranged substantially in a concentric position with the inner wall; and a lower casing hermetically joined to the outer wall, wherein the oil is separated from the working gas. Further, in this aspect, the outer wall, or the outer wall up to the lower casing may be integrated with the main body casing of the compressor.

According to another aspect of the invention, there is provided an oil injected screw compressor in which oil is injected into working gas to cool the working gas and which includes: a male rotor arranged substantially in a horizontal direction; a female rotor arranged in parallel to the male rotor; a main body casing of the compressor having a rotor casing for containing these rotors; an outer cylindrical wall located under the rotor casing and having a center axis substantially in a vertical direction; and an inner wall arranged on an inner circumferential side of the outer wall and having an outer diameter smaller than an inner diameter of the outer wall, wherein the working gas containing the oil is guided into a clearance between the inner wall and the outer wall. Further, in this aspect, the compressor may include a lower casing joined to a flange provided on the outer wall and that the lower casing and the main body casing of the compressor form an oil separating mechanism of the working gas.

According to still other aspect of the invention, there is provided an oil injected screw compressor in which oil is injected into working gas to cool the working gas and which includes: a male rotor arranged substantially in a horizontal direction; a female rotor arranged in parallel to the male rotor; a main body casing of the compressor having a rotor casing for containing these rotors; an inner cylindrical wall located under the rotor casing and having a center axis substantially in a vertical direction; and an outer wall arranged substantially in a concentric position with the inner wall, wherein a first passage for guiding the working gas compressed by the male rotor and the female rotor to a second passage formed between the outer wall and the inner wall is formed under a side portion of the rotor casing.

Further, in any one of the aspects, a discharge port for guiding the working gas guided into the clearance between the outer wall and the inner wall from a space inside the inner wall to the outside of the main body casing of the compressor may be formed in the side portion of the main body casing of the compressor. Still further, it is also recommended that a case for containing an oil separating element that separates the oil contained in the compressed gas and is shaped like a filter be provided on the main body casing of the compressor.

Still further, it is also recommended that a manifold be attached to the discharge port formed in the main body of the compressor and that the case for containing the oil separating element which separates the oil contained in the compressed gas and is shaped like a filter be joined to the manifold. Still further, it is also recommend that a D casing having a discharge port be provided on the working gas discharge side of the rotor casing and that a leg part be provided on the lower casing.

The oil separating case is directly joined to the lower portion of the main body of the compressor to flow working gas, which is a mixture of the compressed gas and the oil and is discharged from the discharge port, along the outer wall from the discharge port, whereby large oil drops can be primarily separated from the compressed gas. The compressed gas from which the oil is primarily separated flows up in the space inside the inner wall and then flows into the oil separating element. With this, the oil can be separated from the working gas so that the gas has the oil of a concentration as small as about three digits, as compared with that of the conventional compressor in the related art.

The other aspects, objects and advantages of the invention will become clear from the following description taken in conjunction with the accompanying drawings.

DETAILED DESCRIPTION OF THE INVENTION

Figure 1:
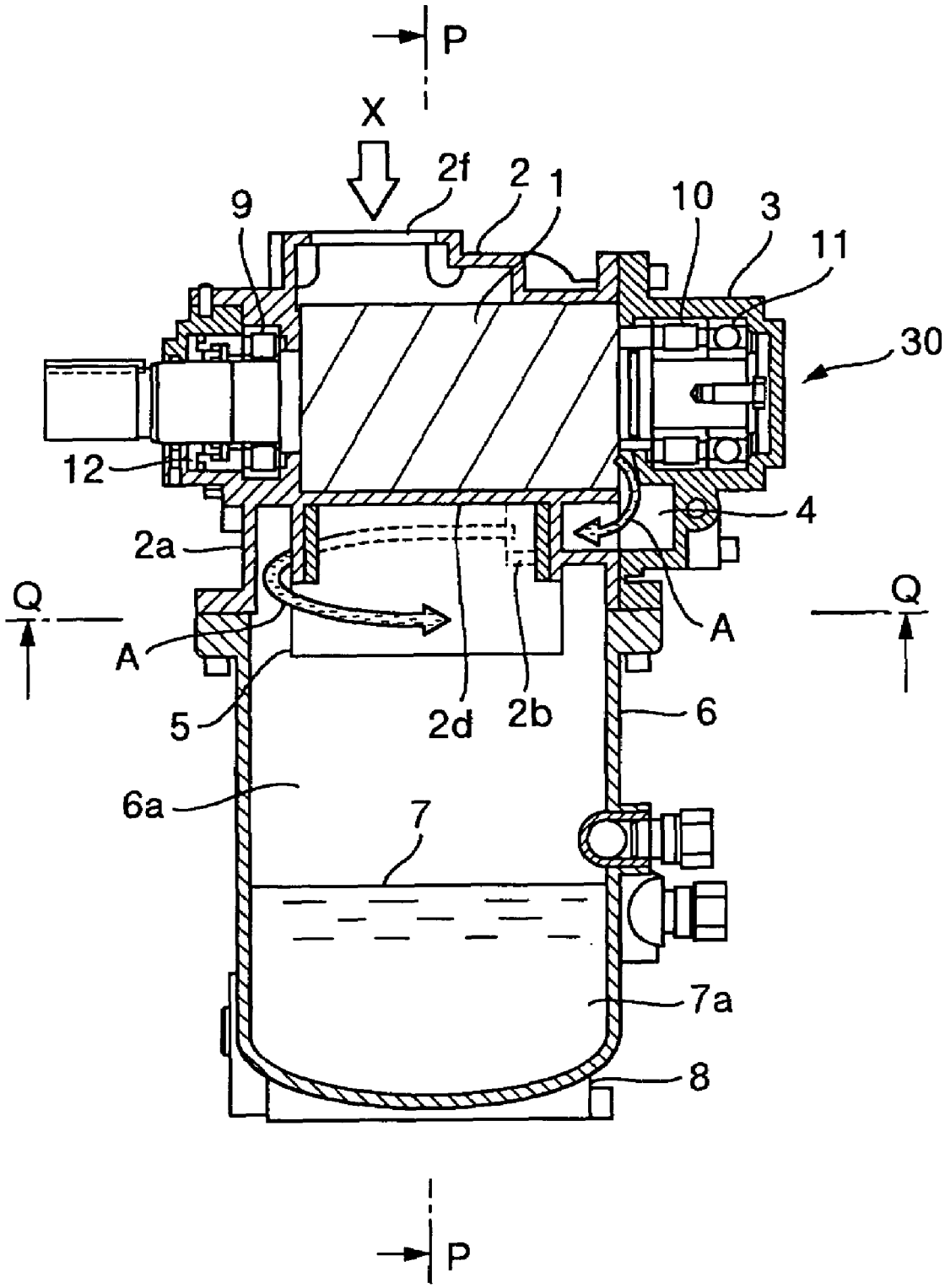
FIG. 1 is a longitudinal cross-sectional view of one embodiment of an oil injected screw compressor in accordance with the invention.

Hereafter, one embodiment of an oil injected screw compressor in accordance with the invention will be described with reference to FIG. 1 to FIG. 3. These drawings illustrate a screw air compressor that is one kind of oil injected screw compressors.

A male rotor 1 and a female rotor 16 are rotated while they are being engaged with each other, so as to suck suction air shown by an arrow X into a casing 2 which contains the male rotor 1 and the female rotor 16. A screw rotor having the male rotor 1 or the female rotor 16 is rotatably supported by bearings 9, 10, and 11 on portions closer to ends than a portion having a rotor tooth form formed thereon. Either the male rotor 1 or the female rotor 16 is coupled to an electric motor (not shown).

When the electric motor coupled to one of the rotors is rotated, air sucked through a suction port 2*f* formed in the casing 2 is compressed by the tooth form portions of the respective rotors. In this process of compressing air, compression heat is generated. Hence, lubricating oil is injected into a compression chamber so as to dissipate the compression heat and to lubricate the gaps between the male rotor 1, the female rotor 16 and the inner wall of a rotor casing 2*d*. The compressed air mixed with oil flows into a discharge chamber 4 provided under a D casing 3 coupled to the discharge side of the casing 2 with bolts or the like.

Under the rotor casing 2*d* containing the male rotor 1 and the female rotor 16 is formed an inner cylindrical wall portion 5 having a center axis in a direction substantially orthogonal to the rotary shafts of these rotors placed horizontally, that is, in a vertical direction. This inner cylindrical wall portion 5 is formed separately from the casing 2 and is fastened to the casing 2 with bolts. Here, although the inner cylindrical wall portion 5 is separately formed from the casing 2 in this embodiment, needless to say, it may be cast integrally with the casing 2.

Under the D casing 3 of the casing 2 is formed an outer cylindrical wall portion 2*a* having a center axis in a vertical direction. That is, the inner cylindrical wall portion 5 and the outer cylindrical wall portion 2*a* are formed substantially in a concentric manner. A lower casing 6 is hermetically attached to the lower portion of the outer cylindrical wall portion 2*a*. The bottom surface of this lower casing 6 has an end plate structure and is adapted to be able to contain high-pressure compressed gas containing oil. The lower portion of the lower casing 6 forms an oil tank 7*a* capable of containing lubricating oil separated from the compressed air and lubricating oil supplied to the portions to be lubricated of the main body 30 of the compressor.

Figure 2:
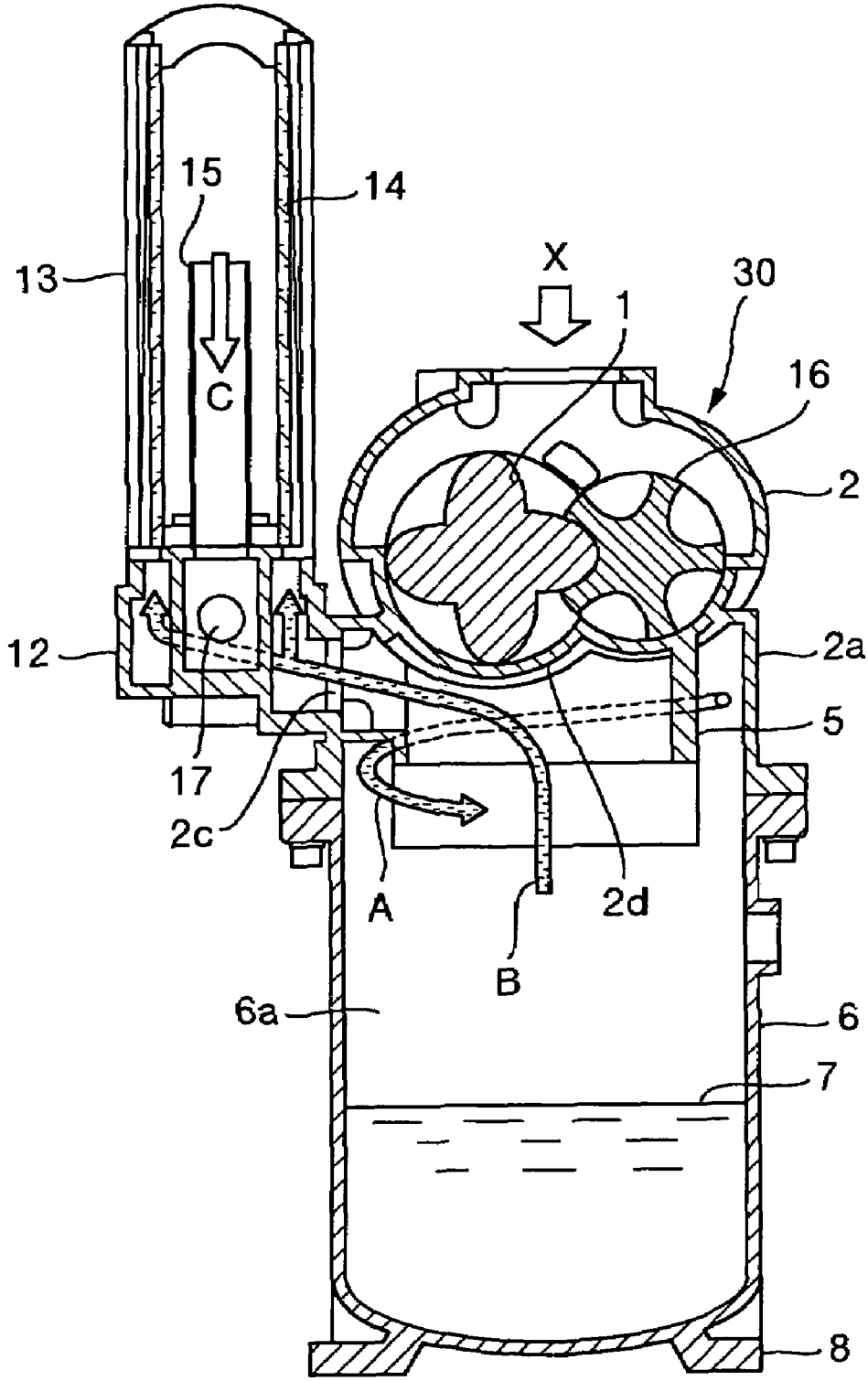
FIG. 2 is a cross-sectional view taken along a line P—P in FIG. 1.

In this embodiment constructed in this manner, the compressed air flowing into the D casing is not discharged quickly from the D casing but is made to do a U-turn back to a discharge passage 2*b* provided in the casing 2, as shown by an arrow A in FIG. 1 and FIG. 2. The reasons for this are as follows.

Figure 3:
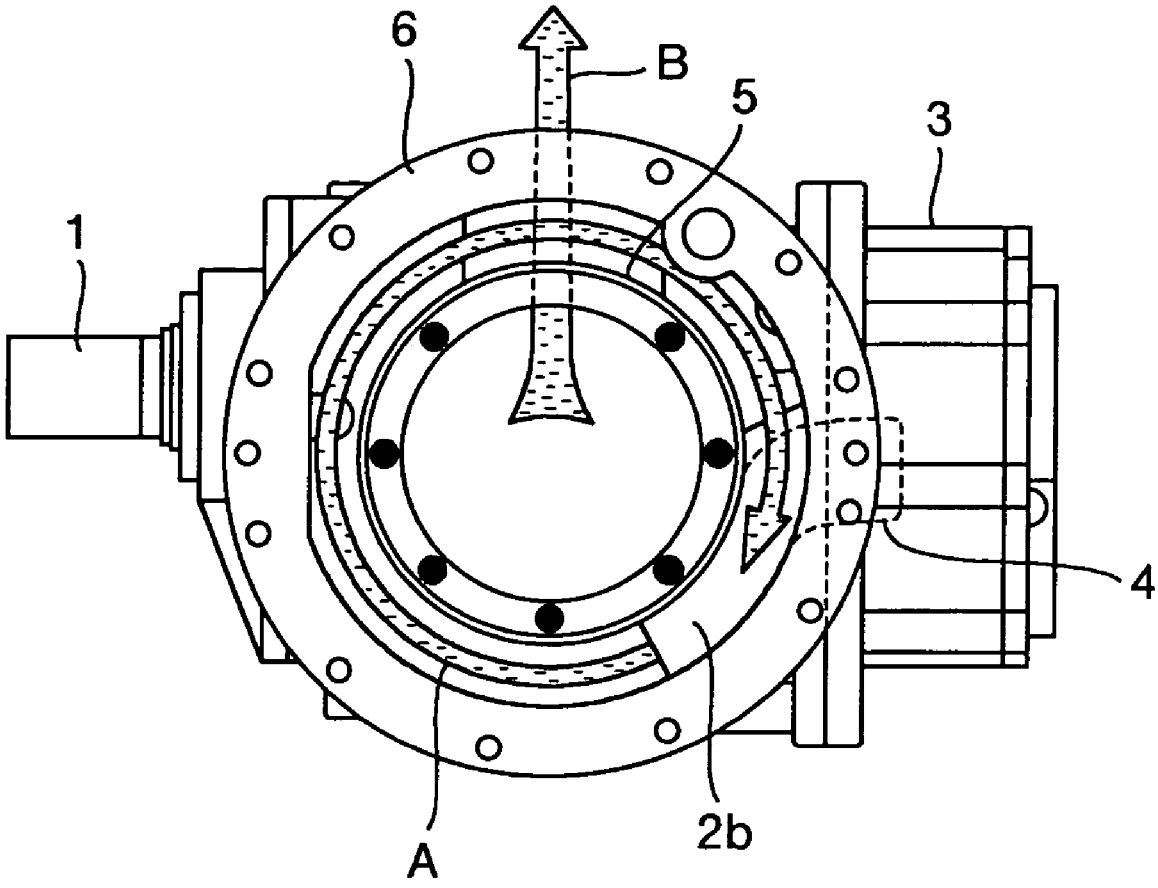
FIG. 3 is a cross-sectional view taken along a line Q—Q in FIG. 1.

As shown in detail in FIG. 3, the discharge passage 2*b* is formed in a circular shape on the inner circumferential side of the outer cylindrical wall portion 2*a*. With the structure, the compressed air that flows into the discharge chamber 4 and contains oil flows in the shape of a swirl flow shown by an arrow A into a space defined between the outer cylindrical wall portion 2*a* and the inner cylindrical wall portion 5. While the swirl of the compressed air is in progress, the velocity of flow of the compressed air is reduced by friction or the like. When the velocity of flow of the compressed air is reduced, oil is separated from the compressed air by the difference in specific gravity between air and oil. While the separated oil flows along the inner surface of the outer cylindrical wall portion 2*a*, it swirls down toward the oil tank 7*a* of the lower casing 6. The oil primarily separated in this manner from the compressed air is stored in the oil tank 7*a* of the lower casing 6, and then is guided into and cooled in an oil cooler (not shown), and is recirculated for use to lubricate and cool the main body of the compressor. Here, since the lower casing 6 is provided with a leg 8, an identified main body of the compressor with oil separating mechanism can stand by itself on a base (not shown) for installing an oil injected screw compressor.

As shown in FIG. 3, the outlet of the discharge passage 2*b* is directed toward the female rotor 16 so that the compressed air flows toward the female rotor 16 side, that is, toward the down side in FIG. 3. The reasons for this are as follows. In general, the female rotor 16 is designed to be in smaller in diameter than the male rotor 1. For this reason, when the male rotor 1 and the female rotor 16 are horizontally placed, the bottom surface of the casing 2 on the female rotor 16 side becomes higher than the bottom surface on the male rotor 1 side (see FIG. 2). As a result, a port through which the compressed air having a higher oil content flows can be set at a position higher than and separate from the oil surface 7 of the lower casing 6. Moreover, oil can be swirled along the outer cylindrical wall portion 2*a* to be separated from the compressed air, thereby being smoothly dropped in the oil tank 7*a* of the lower casing 6.

The concentration of the oil in the compressed air from which oil is primarily separated is reduced to about 1/1000 times that in the compressed air from which oil is not yet separated. The compressed air reduced in the concentration of oil enters inside the inner cylindrical wall portion 5 from the space 6*a* in the oil separator having the casing 2 and the lower casing 6 and flows upward in the inner cylindrical wall portion 5 (arrow B). Then, the flow direction of the compressed air is changed by the casing portion of the rotor below the male rotor 1 and the female rotor 16, and the compressed air flows toward a discharge port 2*c* formed in an upper portion on the side of the casing.

According to this embodiment, the discharge port of the compressed air from which oil is primarily separated is provided in the upper portion of the casing 2, so the distance between the oil surface 7 of the oil tank portion 7*a* and the discharge port 2*c* of the compressed air from which oil is primarily separated can be set at a large value. Hence, this can prevent oil from swirling up from the oil surface 7 toward the discharge port 2*c*.

The compressed air from which oil is primarily separated flows into a manifold 12 joined to the side of the discharge port 2*c*. An oil separating element case 13 is substantially vertically mounted on the top of this manifold 12. A cylindrical oil separating element 14 is attached into the oil separating element case 13 with a clearance between itself and the inner wall surface of the oil separating element case 13. The compressed air from which oil is primarily separated and which flows into the manifold 12 flows into the oil separating element 14 through the clearance between the inner wall of the oil separating element case 13 and the oil separating element 14.

When the compressed air from which oil is primarily separated passes through the oil separating element 14, the concentration of oil in the compressed air is further reduced to about 1/1000. Then, the compressed air from which the oil is secondarily separated by this oil separating element 14 flows downward as shown by an arrow C in a pipe 15 provided on the inner circumferential side of the oil separating element 14 and is discharged from the discharge port 17 formed in the manifold 12 with its oil content remarkably reduced. On the other hand, the oil filtered and separated by the oil separating element 14 is returned to the suction side of the compressor through a hole (not shown) formed in the upper portion of the manifold 12.

According to this embodiment, oil content contained by the compressed air discharged from the main body casing of the compressor is reduced to about 1/1000 times that of the compressor in the related art. Moreover, since portions such as oil separating element 14 and the like are directly joined to the main body casing 2 of the compressor, piping between the main body of the compressor and the oil separating mechanism is not required which is required in the compressor in the related art, whereby the oil-cooled type compressor can be reduced in size. Furthermore, since the lower casing is directly joined to the main body casing of the compressor to make the main body casing of the compressor serve as a portion of the lower casing, a casing structure can be reduced in size. Although the casing is reduced in size, the distance from the oil surface in the oil tank portion to the inlet and discharge ports of the compressed air can be set at a large value, which can improve the efficiency of primary oil separation.

Further, according to this embodiment, the main body of the compressor is integrated with the lower casing and this integrated casing is provided with the installation leg, so a base or the like for supporting the main body of the compressor does not need to be provided. Still further, the oil separating element mechanism that secondarily separates oil from the compressed air from which oil is primarily separated can be attached to the side of the compressor casing through the manifold, so the concentration of oil in the compressed air can be reduced to a level of ppm. In addition, the compressed air having an oil content reduced to such a low concentration can be supplied from a compact integrated unit, which can improve the usability of the compressed air and further can remarkably reduce environmental pollution.

Although the male rotor and the female rotor are arranged in parallel in the horizontal direction in the above embodiment, it is also recommended, for example, to arrange the male rotor to an upper position and that the female rotor to a lower position. Even in this case, it is desirable that the shafts of the rotors are arranged in the horizontal direction. This arrangement of the rotors can make the compressor compact in size and is most suitable for a small-capacity compressor.

According to the invention, the oil separating mechanism is integrated with the main body of the compressor in the oil injected screw compressor, so the oil injected screw compressor can be made compact in size.

It should be further understood by those skilled in the art that the foregoing description has been made on embodiments of the invention and the at various changes and modifications may be made in the invention without departing from the spirit of the invention and the scope of the appended claims.

What is claimed is:

1. An oil injected screw compressor in which oil is injected into working gas to cool the working gas, the compressor comprising:

a male rotor arranged substantially in a horizontal direction;

a female rotor arranged in parallel to said male rotor;

a main body casing of the compressor having a rotor casing for containing these rotors;

an inner cylindrical wall located under said rotor casing and having a center axis substantially in a vertical direction; and an outer wall arranged substantially in a concentric position with said inner wall, wherein a lower casing is hermetically joined to said outer wall, so as to separate the oil from the working gas.

2. The oil injected screw compressor as claimed in claim 1, wherein said outer wall is integrated with said main body casing of the compressor.

3. The oil injected screw compressor as claimed in claim 1, further comprising a case for receiving an oil separating element that separates the oil contained in compressed gas and Is shaped like a filter, wherein said case is provided on said main body casing of the compressor.

4. The oil injected screw compressor as claimed in claim 1, further comprising a D casing provided on a working gas discharge side of said rotor casing and having a discharge port, and a leg portion provided on said lower casing.

5. The oil injected screw compressor as claimed in claim 1, wherein said outer wall up to said lower casing is integrated with said main body casing of the compressor.

6. The oil injected screw compressor as claimed in claim 1, wherein said inner cylindrical wall is fastened to said rotor casing.

7. The oil injected screw compressor as claimed in claim 1, wherein said inner cylindrical wall is fastened to said rotor casing with bolts.

8. The oil injected screw compressor as claimed in claim 1, wherein said inner cylindrical wall and said rotor casing are integrally formed.

9. The oil injected screw compressor as claimed in claim 1, wherein an extension of the center axis of said inner cylindrical wall passes through said rotor casing.

10. The oil injected screw compressor as claimed in claim 1, further comprising a D casing provided on a working gas discharge side of said rotor casing, said D casing having a discharge port directly discharging the working gas into a clearance between said inner cylindrical wall and said outer wall.

11. An oil injected screw compressor in which oil is injected into working gas to cool the working gas, the compressor comprising:

a male rotor arranged substantially in a horizontal direction;

a female rotor arranged in parallel to said male rotor;

a main body casing of the compressor having a rotor casing for containing these rotors;

an outer cylindrical wall located under said rotor casing and having a center axis substantially in a vertical direction; and an inner wall arranged on an inner circumferential side of said outer wall and having an outer diameter smaller than an inner diameter of said outer wall, wherein the working gas containing the oil is guided into a clearance between said inner wall and said outer wall.

12. The oil injected screw compressor as claimed in claim 11, further comprising a lower casing joined to a flange provided on said outer wall, wherein said lower casing and said main body casing of the compressor form an oil separating mechanism of the working gas.

13. The oil injected screw compressor as claimed in claim 11, wherein a discharge port for guiding the working gas guided between said outer wall and said inner wall from a space inside said inner wall to outside of said main body casing of the compressor is formed in a side portion of said main body casing of the compressor.

14. The oil injected screw compressor as claimed in claim 13, further comprising a manifold attached to said discharge port formed in said main body of the compressor, and a case for receiving an oil separating element that separates the oil contained in compressed gas and is shaped like a filter, wherein said case is joined to said manifold.

15. The oil injected screw compressor as claimed in claim 11, wherein said inner wall is fastened to said rotor casing.

16. The oil injected screw compressor as claimed in claim 11, wherein said inner wall is fastened to said rotor casing with bolts.

17. The oil injected screw compressor as claimed in claim 11, wherein said inner wall and said rotor casing are integrally formed.

18. The oil injected screw compressor as claimed in claim 11, wherein an extension of the center axis of said outer cylindrical wall passes through said rotor casing.

19. The oil injected screw compressor as claimed in claim 11, further comprising a casing D provided on a working gas discharge side of said rotor casing, said D casing having a discharge port directly discharging the working gas into the clearance between said inner wall and said outer cylindrical wall.

20. An oil injected screw compressor in which oil is injected into working gas to cool the working gas, the compressor comprising:

a male rotor arranged substantially in a horizontal direction;

a female rotor arranged in parallel to said male rotor;

a main body casing of the compressor having a rotor casing for containing these rotors;

an inner cylindrical wall located under said rotor casing and having a center axis substantially in a vertical direction; and an outer wall arranged substantially in a concentric position with said inner wall, wherein a first passage for guiding the working gas compressed by said male rotor and said female rotor to a second passage formed between said outer wall and said inner wall is formed under a side portion of said rotor casing.

21. The oil injected screw compressor as claimed in claim 20, wherein said inner cylindrical wall is fastened to said rotor casing.

22. The oil injected screw compressor as claimed in claim 20, wherein said inner cylindrical wall is fastened to said rotor casing with bolts.

23. The oil injected screw compressor as claimed in claim 20, wherein said inner cylindrical wall and said rotor casing are integrally formed.

24. The oil injected screw compressor as claimed in claim 20, wherein an extension of the center axis of said inner cylindrical wall passes through said rotor casing.

* * * * *